US009661706B2

(12) United States Patent
Murphy

(10) Patent No.: US 9,661,706 B2
(45) Date of Patent: May 23, 2017

(54) LOW INTENSITY DIMMING CIRCUIT FOR AN LED LAMP AND METHOD OF CONTROLLING AN LED

(71) Applicant: Ruud Lighting, Inc., Racine, WI (US)

(72) Inventor: Matthew K. Murphy, Mukwonago, WI (US)

(73) Assignee: Cree, Inc., Durham, NC (US)

( * ) Notice: Subject to any disclaimer, the term of this patent is extended or adjusted under 35 U.S.C. 154(b) by 190 days.

(21) Appl. No.: 13/728,660

(22) Filed: Dec. 27, 2012

(65) Prior Publication Data

US 2014/0184076 A1 Jul. 3, 2014

(51) Int. Cl.
*H05B 33/08* (2006.01)

(52) U.S. Cl.
CPC ..... *H05B 33/0824* (2013.01); *H05B 33/0848* (2013.01); *H05B 33/0851* (2013.01)

(58) Field of Classification Search
CPC ..... H05B 33/00; H05B 33/08; H05B 33/083; H05B 33/0845; H05B 33/0884; H05B 37/00
USPC ..... 315/121, 119, 123, 125, 291, 306, 300, 315/302, 307–308
See application file for complete search history.

(56) References Cited

U.S. PATENT DOCUMENTS 4,395,660 A 7/1983 Waszkiewicz
5,283,516 A * 2/1994 Lohoff ..... G05F 1/455 323/241
5,739,710 A * 4/1998 Baik ..... H05B 33/0806 327/108
6,323,598 B1 11/2001 Guthrie et al.
6,593,709 B2 7/2003 Lee et al.
6,670,776 B2 12/2003 Guthrie et al.
6,737,814 B2 5/2004 Guthrie et al.
7,145,295 B1 12/2006 Lee et al.
7,157,859 B2 1/2007 Inoue
7,221,107 B2 5/2007 Melis
7,256,554 B2 * 8/2007 Lys ..... F21S 48/325 315/224
7,321,203 B2 1/2008 Marosek
7,391,169 B2 6/2008 Huang et al.
7,462,995 B2 12/2008 Hamidian et al.
7,714,516 B2 5/2010 Ito et al.
7,723,926 B2 5/2010 Mednik et al.
7,791,326 B2 9/2010 Dahlman et al.
(Continued)

FOREIGN PATENT DOCUMENTS

WO WO 2005/038476 4/2005

OTHER PUBLICATIONS

International Search Report and Written Opinion dated Apr. 24, 2014 for International Application No. PCT/US2013/078076, Applicant, Cree, Inc. (12 pages).

*Primary Examiner* — Jimmy Vu
*Assistant Examiner* — Henry Luong
(74) *Attorney, Agent, or Firm* — McCracken & Gillen LLC

(57) ABSTRACT

A driver is connectable to an external power supply and configured to output a variable driving current for one or more loads, such as LEDs. A low intensity dimming module is operable to divert some or all of the driving current away from the LEDs when a user selects a very low level of light intensity so that the driver has a constant minimum load. The low intensity dimming module prevents performance issues that commonly affect drivers under light load conditions.

29 Claims, 10 Drawing Sheets

(56) References Cited

U.S. PATENT DOCUMENTS

| | | | | |
|---|---|---|---|---|
| 7,902,761 | B2 | 3/2011 | Ang et al. | |
| 7,919,925 | B2 | 4/2011 | Ito et al. | |
| 7,956,553 | B2 | 6/2011 | Chen et al. | |
| 8,084,962 | B2 | 12/2011 | van Beckhoven | |
| 8,134,302 | B2 | 3/2012 | Yang et al. | |
| 2007/0262724 | A1 | 11/2007 | Mednik et al. | |
| 2008/0297060 | A1 | 12/2008 | Ko et al. | |
| 2009/0079358 | A1* | 3/2009 | Shteynberg | H05B 33/0818 315/291 |
| 2009/0179575 | A1 | 7/2009 | Mednik et al. | |
| 2009/0195191 | A1* | 8/2009 | Lin | H05B 33/0818 315/307 |
| 2010/0013405 | A1 | 1/2010 | Thompson et al. | |
| 2010/0045190 | A1 | 2/2010 | Cramer | |
| 2010/0295469 | A1 | 11/2010 | Coley | |
| 2011/0057576 | A1 | 3/2011 | Otake et al. | |
| 2011/0068706 | A1* | 3/2011 | Otake | H05B 33/0824 315/291 |
| 2011/0193488 | A1 | 8/2011 | Kanamori et al. | |
| 2011/0254469 | A1 | 10/2011 | Ruan et al. | |
| 2012/0056554 | A1 | 3/2012 | Alexandrovich et al. | |
| 2012/0062138 | A1 | 3/2012 | Wilson et al. | |
| 2012/0104975 | A1 | 5/2012 | Vigh et al. | |
| 2012/0194079 | A1* | 8/2012 | Clauberg | H05B 33/0815 315/125 |
| 2012/0286686 | A1* | 11/2012 | Watanabe | H05B 33/0815 315/224 |
| 2013/0106298 | A1* | 5/2013 | Datta | H05B 33/0815 315/186 |
| 2014/0062330 | A1* | 3/2014 | Neundorfer | H05B 39/044 315/224 |

* cited by examiner

LOW INTENSITY DIMMING CIRCUIT FOR AN LED LAMP AND METHOD OF CONTROLLING AN LED

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to lamp modules, and more particularly to an electronic module for dimming a lighting fixture near a minimum current capability of a lighting fixture driver.

2. Description of the Background of the Invention

Lamp drivers have been devised that provide power to one or more lamp loads, such as one or more light emitting diodes (LEDs). Using LEDs in lamps has become particularly popular of late because LEDs develop a very bright light output while consuming relatively little power compared to other types of lamps.

Some lamp drivers have been designed to provide variable power to LEDs to obtain a dimming effect. Such drivers may provide variable power in response to a user input or according to a predetermined schedule that is implemented by a controller. In known designs for driving one or more LEDs in a dimmable manner, the lamp driver receives power from a power supply (such as residential or commercial power supplied by an electric utility) to power circuit element(s) that develop a driving current.

In order to dim an LED, drivers typically reduce the average current delivered to the LEDs. Specifically, an alternating current (AC) waveform is typically phase controlled in accordance with a dimming control signal to control average current. Less average current typically translates into less light intensity. However, such a control scheme can be problematic when attempting to dim an LED lamp to very low levels of light intensity. AC/DC power supplies typically suffer from a minimum load requirement which start to affect performance at approximately $1/10^{th}$ to $1/20^{th}$ rated power output. Power supplies typically go into burst mode under these light load conditions to maintain a constant output. Thus, any power level requested below these limits can cause instability in the light levels and produce side effects such as blinking, flicker, audible noise, or even complete loss of light.

SUMMARY OF THE INVENTION

According to one aspect of the present invention, a dimmable lighting device includes at least one LED, an LED driver configured to develop a driving current to power the at least one LED, and a dimming control circuit that includes a shunt load. The dimming control circuit is configured to divert current from said at least one LED through said shunt load in response to the driving current being below a low intensity level.

According to another aspect of the present invention, a dimming circuit for a lighting device, includes a first current path configured to be connected to a light emitting diode (LED) driver, wherein the LED driver is configured to develop a driving current to power at least one LED. The dimming circuit further includes a second current path connected to the first current path, wherein the second current path includes a shunt load and a dimming control circuit that causes current to flow in the shunt load and controls current flow through one of the first current path and the second current path when a commanded driving current is less than or equal to a low intensity level.

According to yet another aspect of the present invention, a method of controlling a light emitting diode (LED) includes the steps of providing a driving current to power the LED and shunting a portion of the driving current away from the LED when the driving current is less than a predetermined value.

BRIEF DESCRIPTION OF THE DRAWINGS

Further aspects of the present invention will become evident by a reading of the attached specification and inspection of the attached drawings in which.

DETAILED DESCRIPTION OF THE PREFERRED EMBODIMENTS

Figure 1A:
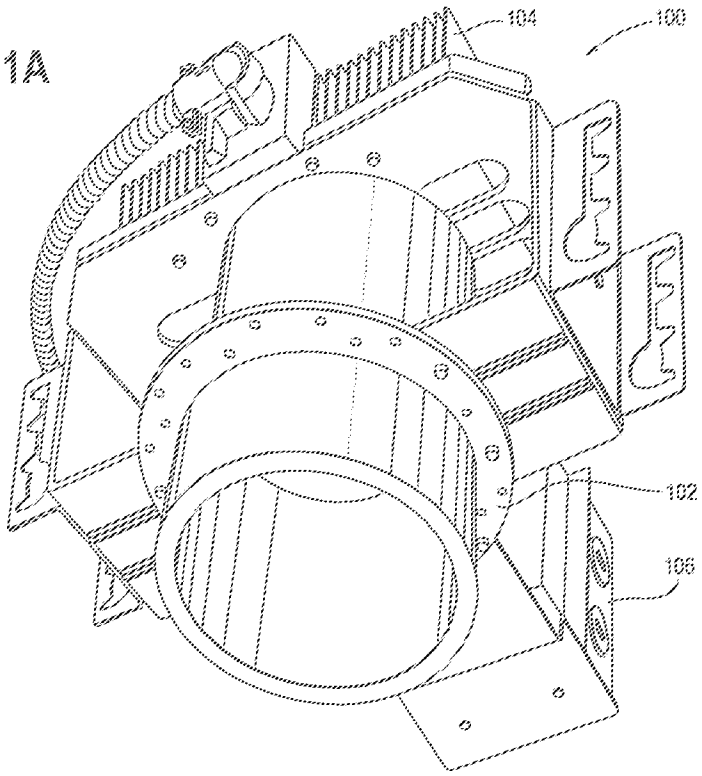
FIG. 1A is an isometric view of a bottom, right, and front of a lighting apparatus.
Figure 1B:
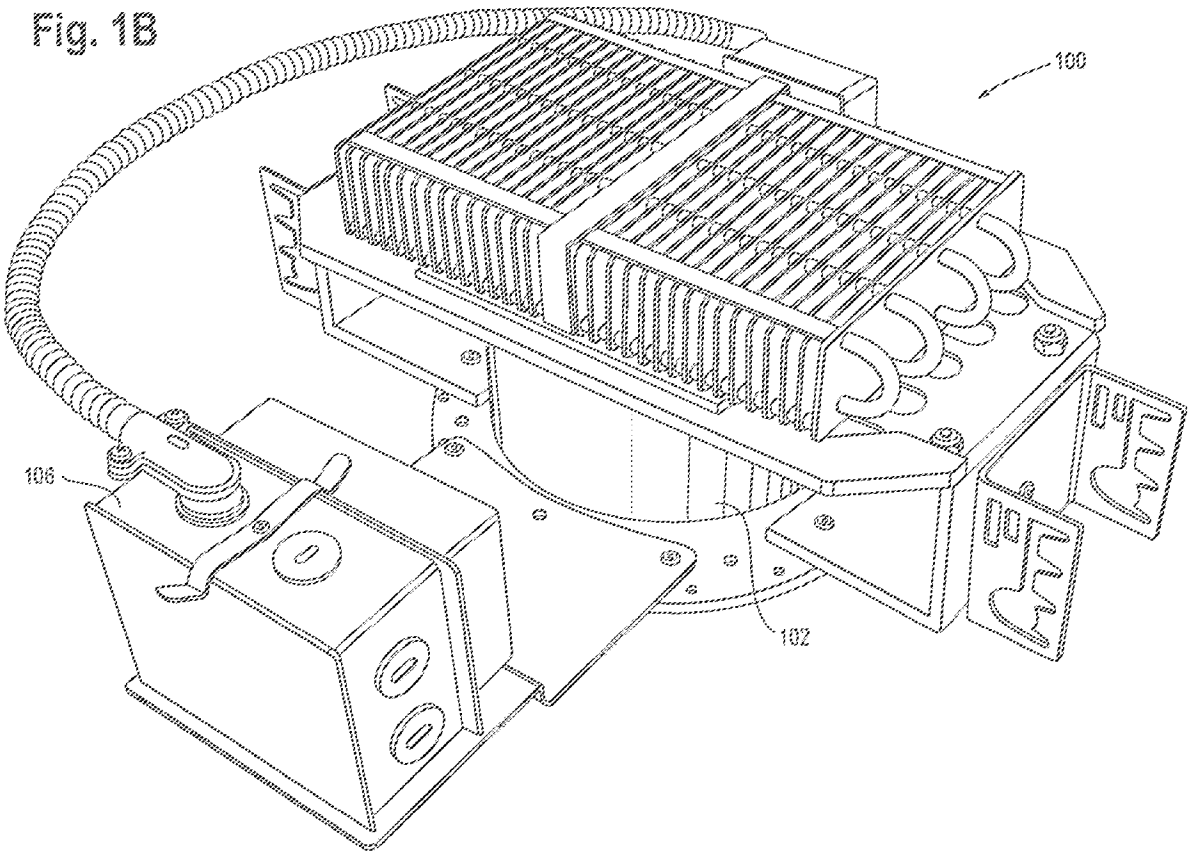
FIG. 1B is an isometric view of a top, left, and back of the lighting apparatus shown in FIG. 1A.

The present invention contemplates a dimmable lighting apparatus 100 that emits light at relatively low levels of intensity. The lighting apparatus may be of any suitable size and/or shape and/or may be adapted for mounting in a ceiling, wall, or other surface, or may be free-standing as illustrated in the embodiment shown in FIG. 1. The lighting apparatus 100 shown in FIG. 1 includes a lamp housing 102, a heat sink 104, and a junction box 106. The housing 102 is configured to secure the components of the lighting apparatus 100 and direct the light emitted by the lighting apparatus 100. The heat sink 104 is configured to conduct and dissipate thermal energy radiated by the lighting apparatus 100, The junction box 106 is configured to hold, among other things, class I and/or class II wiring that electrically connects the lighting apparatus 100 to an external power source and possibly an external control box. The junction box 106 may also hold electrical components such as a driver and/or low intensity dimming module that are utilized by the lighting apparatus 100.

Figure 2A:
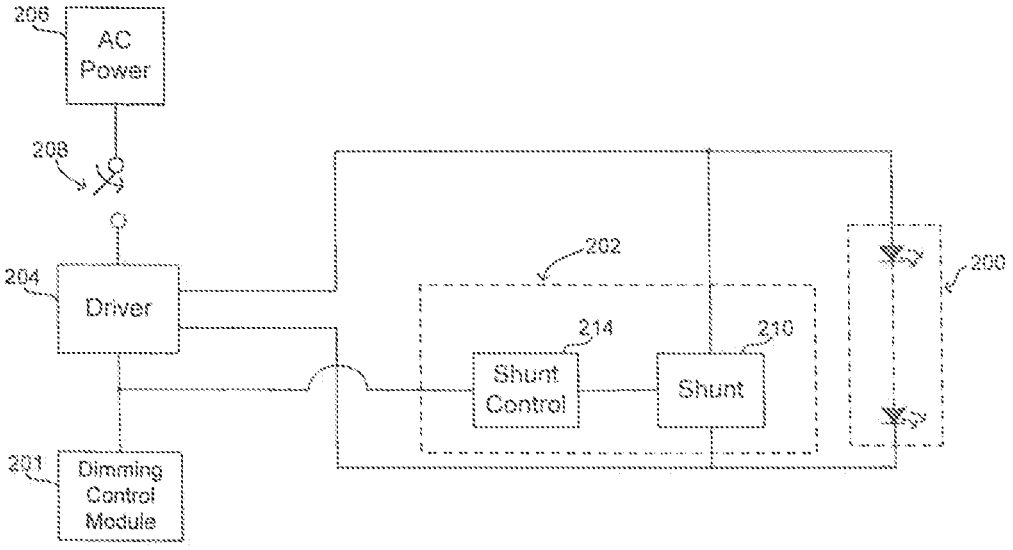
FIG. 2A is a lighting apparatus control circuit block diagram corresponding to a first embodiment of the present invention.
Figure 2B:
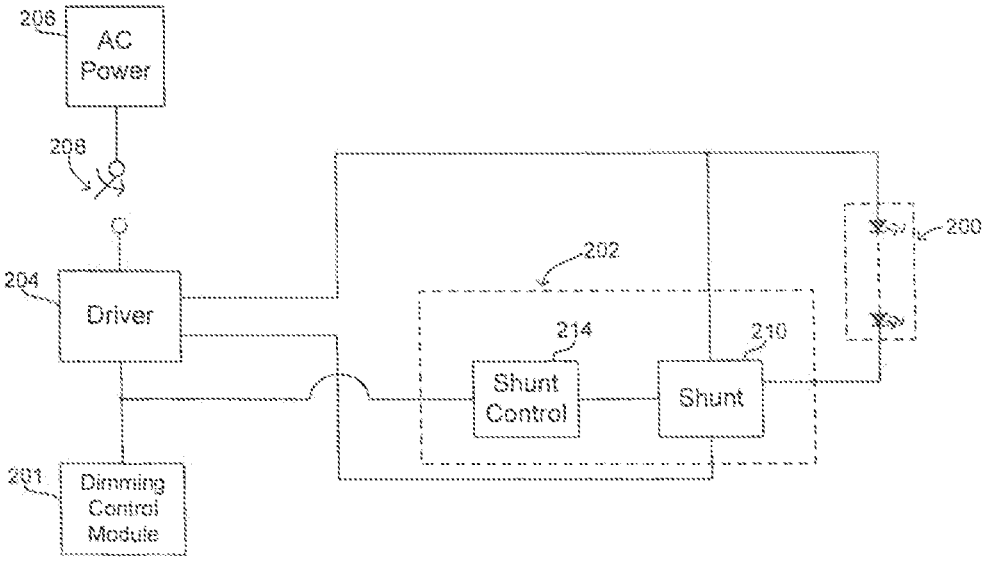
FIG. 2B is a lighting apparatus control circuit block diagram corresponding to a second, third, and fourth embodiment of the present invention.

In one embodiment, the lighting apparatus 100 uses at least one, and preferably a plurality of light emitting diodes (LEDs) 200 to emit light, as shown in FIGS. 2A and 2B. The light by the LED(s) 200 may be of different intensities or other variable visual characteristic(s), such as emitted light color in a "true color" system, depending upon the desires of a user or operator. A user or operator may adjust a manual control switch associated with the lighting apparatus 100 to vary the intensity of the emitted LED 200 light, Alternatively or in addition, the lighting apparatus 100 may include a programmable or switchable device, such as a microcontroller, an ASIC, etc, that can be switched or programmed to vary the intensity and/or other visual or other operational characteristic of the emitted LED 200 light automatically according to a predetermined function or algorithm. Thus, for example, the intensity may be controlled as a function of time of day, Alternatively or additionally, a user may operate the programmable or switchable device at any given time to vary the intensity of the emitted LED 200 light according to the desires of the user at that time.

No matter the manner of control, the present disclosure contemplates adjustment of the light intensity of the LED(s) 200 by a dimming control circuit, which may be in the form of a module or other device 201 coupled to an LED driver 204 that develops a driving current. In some embodiments, the dimming control circuit 201 outputs a dimming command signal DIM_IN that varies between 0 and 10 volts in response to an adjustment command by a user. In other embodiments, the dimming control circuit 201 may output a dimming command signal DIM_IN that has a voltage range larger than 0 to 10 volts (e.g., 0 to 20 volts, −30 to 30 volts, etc.) or smaller than 0 to 10 volts (e.g., 0 to 5 volts, −1 to 1 volts, etc.). The dimming command signal DIM_IN allows the lighting apparatus 100 to adjust the light intensity level of the LED(s) 200 appropriately. The present disclosure further contemplates using a low intensity dimming control circuit, which may be in the form of a module or other device 202 to assist when the light intensity of the LED(s) 200 is adjusted to be very low. The low intensity dimming control circuit 202 may be located in the junction box 106 of the lighting apparatus 100.

An example lighting apparatus control circuit corresponding to a first embodiment of the present invention is shown generally in FIG. 2A. An example lighting apparatus control circuit corresponding to second, third, and fourth embodiments of the present invention is shown generally in FIG. 2B. As shown in FIGS. 2A and 2B, the dimming control module 201 is configured to be in electrical communication with the LED driver 204. The LED driver 204 is configured to be in electrical communication with an external AC power source 206, the dimming control module 201, a low intensity dimming module 202, and the LED(s) 200. The current path between the LED driver 204 and the external power source 206 is configured to be switchable between an open connection and a closed connection through a switch 208. As shown in FIG. 2A, the LED(s) 200 and low intensity dimming module 202 comprising a shunt 210 are connected in parallel in the first embodiment, In the second, third, and fourth embodiments seen in FIG. 213, the LED(s) 200 and shunt 210 are connected partially in parallel. In any event, a shunt control 214 regulates the operation of the shunt 210 so that the shunt 210 is active and conductive under certain conditions and inactive and non-conductive under other conditions. When the shunt 210 is active a portion of the driving current developed by the driver 204 is conducted through the shunt 210, while another portion of the driving current powers the LED(s) 200. Control of the LED current, when the module 202 is active, may be accomplished by regulating either shunt current or LED current. When the shunt 210 is inactive, all or substantially all of the driving current is delivered to the LED(s) 200.

The driver 204 comprises a controllable constant current source and develops direct current (DC) power (or AC power if desired) that is generally regulated in accordance with a magnitude of the dimming command signal DIM_IN developed by the dimming control module 201 on one or more lines. The power developed by the driver 204 is delivered to the LED(s) 200 such that the LED(s) 200 emit a selected light intensity and/or one or more other operational characteristic(s) are controlled. The driver 204 also ensures that the LED(s) 200 do not receive too much power such that they prematurely burn out. The driver 204 may further protect against fault conditions and maintain compliance with safety standards.

The low intensity dimming module 202 ensures that minimum output parameters specified for the driver 204 are adhered to such that the driver 204 does not have so small of a load that performance issues become apparent. In particular, the low intensity dimming module 202 ensures that the driver 204 does not have so small of a load that the driver 204 develops (or attempts to develop) a current at or below a minimum current magnitude. As described in greater detail below, when the dimming control module 201 commands a lighting level at or below a certain low intensity threshold lighting level (thereby commanding the driver 204 to develop a constant current magnitude at or below a certain low intensity threshold current magnitude), the shunt control 214 operates the shunt circuit 210 to divert a portion of the constant current away from the LED(s) 200 rather than attempting to operate the driver in an unstable or undesirable fashion. The low intensity threshold current magnitude is preferably (although not necessarily) greater than the minimum current magnitude of the driver 204.

The magnitude of the diverted current may be constant or may depend upon the difference between the low intensity threshold lighting level and the commanded light level (or the difference between the low intensity threshold current magnitude and the current magnitude that would otherwise result in operation of the LED(s) 200 at the commanded light level.). In one embodiment, the current diverted through the shunt circuit is regulated and constant when the shunt is active, regardless of the commanded light level. In a further embodiment, the current through the LED(s) 200 is regulated and constant when the shunt is active, regardless of the commanded light level. Regulating the current through the LED(s) 200 is more difficult but results in better performance. In yet other embodiments, the current diverted through the shunt circuit increases and the current through the LED(s) 200 decreases as the difference between the low intensity threshold lighting level and the commanded light level increases.

By maintaining a minimum load on the driver 204 and dividing the current developed by the driver 204 between the shunt circuit 210 and the LED(s) 200, instability and other undesired effects are minimized. Because the low intensity dimming module 202 is preferably located in the junction box 106 and utilizes signals present in such, the shunt control circuit 214 and shunt 210 can be implemented on a single circuit board (if desired) with other components. If control by the low intensity dimming module 202 is precise enough the module 202 could dim the LEDs) 200 to any percentage using a standard 10% or 5% 0-10V driver 204.

Figure 4B:
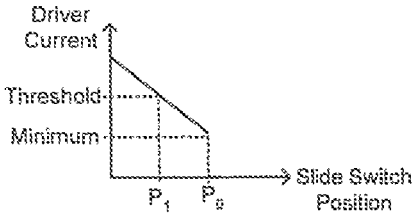
FIG. 4B is a graph of driver current versus slide switch position according to the second embodiment of the present invention.
Figure 4C:
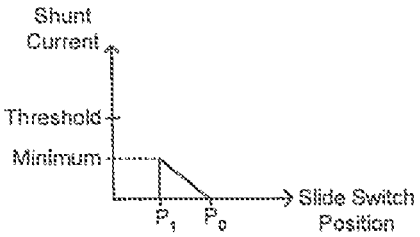
FIG. 4C is a graph of shunt current versus slide switch position according to the second embodiment of the present invention.
Figure 4D:
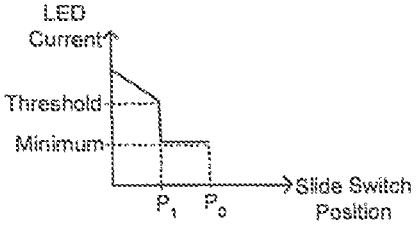
FIG. 4D is a graph of LED current versus slide switch position according to the second embodiment of the present invention.
Figure 5:
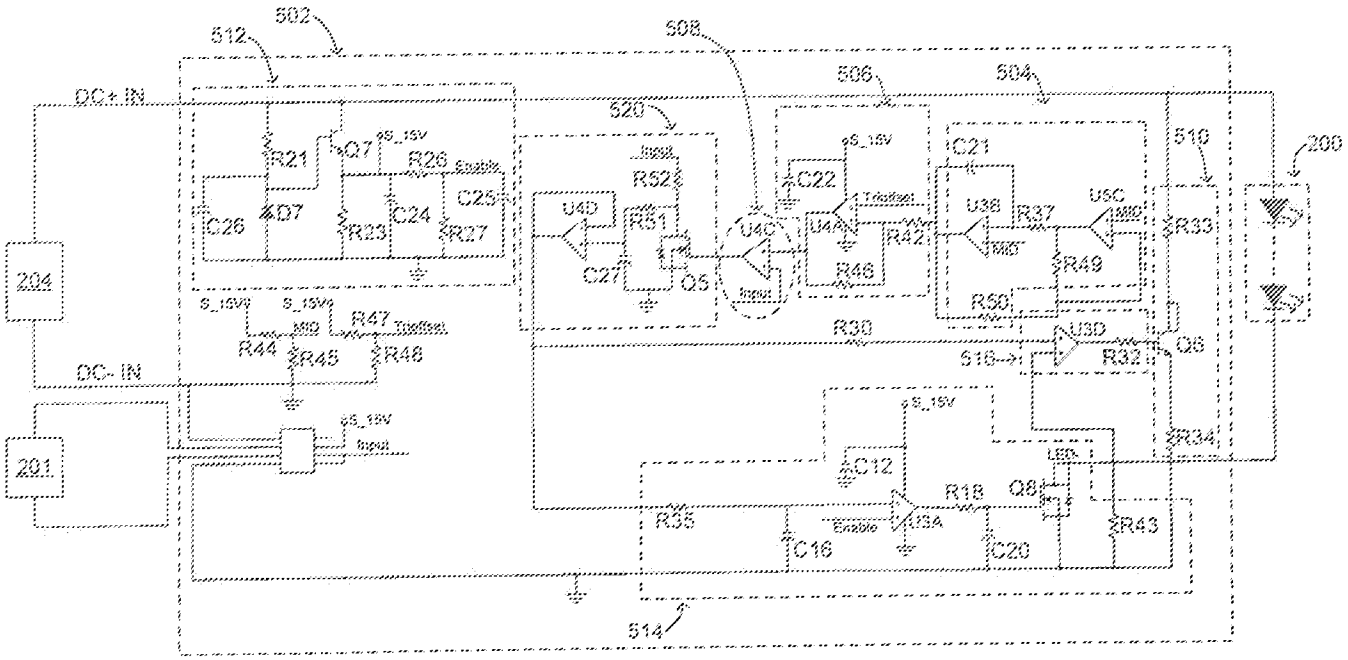
FIG. 5 is a low intensity dimming module circuit schematic according to the third embodiment of the present invention.
Figure 6:
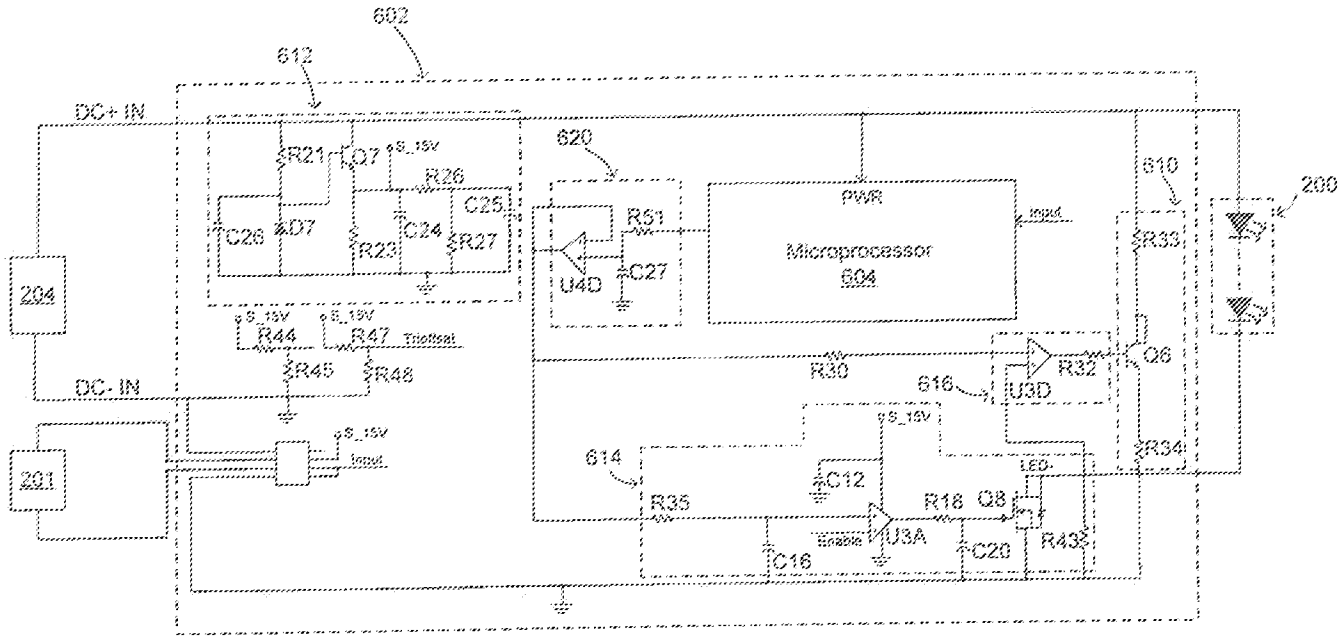
FIG. 6 is a low intensity dimming module circuit schematic according to the fourth embodiment of the present invention.

The low intensity dimming module 202 may be implemented in several ways. A circuit 302 corresponding to a first embodiment is implemented using a shunt current regulated step control, as shown in FIG. 3. A circuit 402 corresponding to a second embodiment is implemented using an LED current regulated step control, as shown in FIG. 4. A circuit 502 corresponding to a third embodiment is implemented using a 0-10V sample control, as shown in FIG. 5. In a circuit 602 corresponding to a fourth embodiment, as shown in FIG. 6, a microprocessor controls LED current under certain dimming conditions.

Figure 3A:
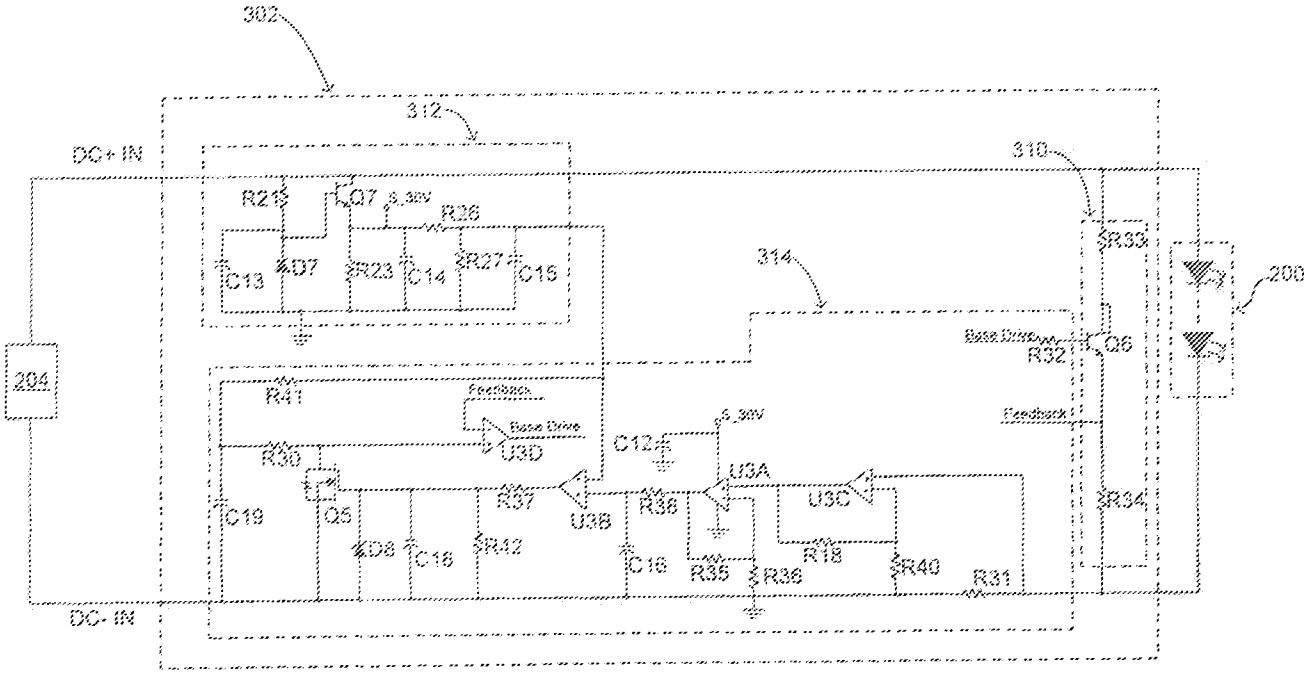
FIG. 3A is a low intensity dimming module circuit schematic according to the first embodiment of the present invention.

Referring first to FIG. 3A, the circuit 302 corresponding to the first embodiment includes DC positive voltage and ground conductors DC+ IN and DC− IN, respectively, which are in turn, coupled to the positive and negative output terminals of the driver 204. A shunt 310 is coupled between the conductors DC+ IN and DC− IN.

The shunt 310 includes load resistors R33 and R34, as well as a bipolar junction transistor (BJT) Q6. The resistor R33 is connected to a collector of BJT Q6, while R34 is collected to an emitter of BJT Q6. A base of BJT Q6 is connected to the output of a shunt control circuit 314, In operation, the shunt 310 is active when the output of the shunt control circuit 314 provides sufficient drive current to turn on BJT Q6. The shunt 310 is otherwise inactive.

The shunt control 314 includes op amps U3 A, U3B, U3C, and U3D; capacitors C12, C16, C18, and C19; resistors R30, R32, R35, R37, R41, R42, R38, R36, R18, R40, and R31; a zener diode D8; and a metal-oxide-semiconductor field-effect transistor (MOSFET) Q5. A feedback signal from the emitter of BUT Q6 is connected to an inverting input of op amp U3D in the shunt 310. A non-inverting input of the op amp U3D is coupled by the resistors R30 and R31 to a voltage regulation circuit 312 that develops a voltage reference signal from the DC voltages on the conductors DC+ IN and ground. The voltage regulation circuit includes resistors R21, R23, R26, and R27; capacitors C13, C14, and C15; a zener diode D7; and a transistor Q7.

The op amp U3C senses the combined current magnitude through the LED(s) 200 and the shunt 310 by measuring the voltage across the resistor R31. The op amps U3C and U3A level shift the signal representing the combined current magnitude. The op amp U3B compares the level shifted signal representing the combined current magnitude against the voltage reference signal developed by the voltage regulation circuit 312. An output signal of the op amp U3B turns the clamping MOSFET Q5 on and off based on the comparison. If the voltage reference signal has a higher magnitude than the level shifted signal representing the combined current magnitude level then the op amp U3B turns the MOSFET Q5 off. If vice versa, the op amp U3B turns the MOSFET Q5 on, thereby clamping the non-inverting input of the op amp U3D to substantially ground potential.

When the total current though the LED(s) 200 and the shunt circuit 310 drops to the low intensity threshold current level the op amp U3A causes the voltage at the non-inverting input of the op amp U3B to become less than the voltage at the inverting input thereof, thereby resulting in turn-off of the transistor Q5 by the op amp U3B. The low level clamping action on the non-inverting input of the op amp U3D is removed, and the op amp U3D operates the transistor Q6 to activate the shunt 310 and maintain the shunt current at a regulated constant level.

The shunt 310 is coupled in parallel with the LED(s) 200 and conducts once a low intensity threshold current level is reached (e.g., 70 mA). In the shunt current regulated step control circuit 302, the shunt current is regulated to a predetermined value and the shunt 310 is either on if the combined current magnitude through the shunt 310 and LED(s) 200 is below the low intensity threshold current level or off if the current magnitude through the LED(s) 200 is above the low intensity threshold current level (the shunt 310 current is zero when the shunt 310 is off). This causes a step in the dimming when the shunt 310 is activated. For example, assume the low intensity threshold current level is set at 70 mA and the shunt current is set to 56 mA. When the commanded LED current is above 70 mA the shunt is off and has no effect on the driver 204 or the LED current.

As the commanded LED current is reduced to 70 mA the shunt turns on and the LED current decreases from 70 mA to 70 mA minus the shunt current (70 mA−56 mA=14 mA LED current). At this point, the dimming control 201 signal DIM_N, which varies between 0-10 volts, is approximately at 1V. Thereafter, if additional dimming is commanded, which may occur in response to movement of a slide switch on the dimming control module 201, or may result from the driver 204 continues to decrease its output current as DIM_IN decreases from approximately 1 volt to about 0.7 volt, This additional decrease in driver current (as DIM_ IN decreases from 1V to 0.7V) has the effect of additional dimming. By adjusting the magnitude at which the shunt current is regulated, the LED(s) 200 can be dimmed anywhere from no additional current reduction to a complete current reduction (i.e., LED(s) 200 off) when the slide switch is completely down. The current through the shunt 310 is dissipated as heat through the two load resistors R33 and R34 and the BJT Q6. If the dimming control module 201 is adjusted to dim the LED(s) 200 further, the shunt 310 ensures that the driver 204 has a minimum load imposed thereon while at the same time diverting current away from the LED(s) 200 so that the LED(s) 200 are operated in the commanded manner while avoiding adverse effects such as flickering.

Figure 3B:
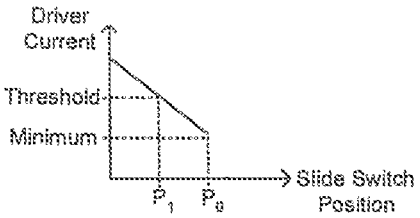
FIG. 3B is a graph of driver current versus slide switch position according to the first embodiment of the present invention.
Figure 3C:
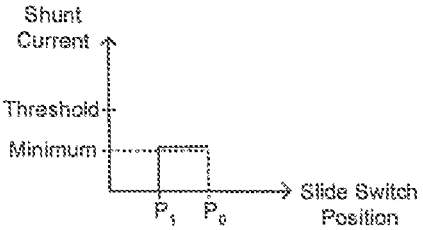
FIG. 3C is a graph of shunt current versus slide switch position according to the first embodiment of the present invention.
Figure 3D:
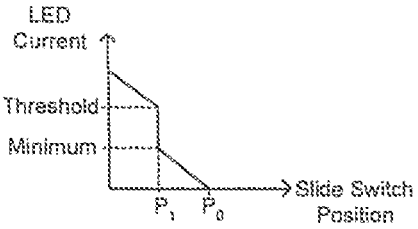
FIG. 3D is a graph of LED current versus slide switch position according to the first embodiment of the present invention.

Referring next to FIGS. 3B-3D, a graph of current versus slide switch position is shown with respect to the operation of the driver 204, the shunt 310, and the LED(s) 200, respectively, according to the first embodiment. As shown in FIG. 3B, the magnitude of the driver current decreases as the slide switch is moved farther down toward an extreme downward position $P_0$ to the right as depicted in the graph).

While the magnitude of the driver current is shown to decrease linearly with respect to slide switch position, the rate of decrease may alternatively be exponential, logarithmic, or any other type of curve known to those of ordinary skill. At position $P_1$, the driver current reaches the low intensity threshold current magnitude and the shunt 310 turns on. The driver current is not affected, however, and continues to decrease as the slide switch moves towards $P_0$. At position $P_0$, the driver current approaches the minimum current magnitude. However, as shown, the driver 204 is configured such that the driver current never actually reaches the minimum current magnitude, so as to avoid any adverse effects.

As shown in FIG. 3C, the magnitude of the shunt current is zero when the magnitude of the driver current is greater than the low intensity threshold current magnitude. At position $P_1$, the driver current magnitude equals the low intensity threshold current magnitude and the shunt 310 is activated. Once activated, the current through the shunt 310 increases from zero to some regulated magnitude. In FIG. 3C, the current through the shunt 310 is regulated to be greater than or equal to the minimum current magnitude. However, the current through the shunt 310 may be regulated to be any magnitude less than or equal to the low intensity threshold current magnitude. Whatever the regulated magnitude of the current through the shunt 310, the current through the shunt 310 remains constant while the shunt 310 is active.

As shown in FIG. 3D, the magnitude of the current through the LED(s) 200 initially decreases along with the driver current when the slide switch is to the left of $P_1$ (as seen in the graph). As the current through the LED(s) 200 decreases so does the intensity of the light produced by the LED(s) 200. While the magnitude of the current through the LED(s) 200 is shown to decrease linearly with respect to slide switch position, the rate of decrease may alternatively be exponential, logarithmic, or any other type of curve known to those of ordinary skill. At position $P_1$, the driver current reaches the low intensity threshold current magnitude and the shunt 310 is activated.

When the shunt 310 is activated the shunt 310 begins to conduct current and the magnitude of the current through the LED(s) 200 decreases accordingly. The magnitude of the step decrease of current through the LED(s) 200 at the transition point $P_1$ is dependent upon the regulated current magnitude of the shunt 310. As the magnitude of the driver current continues to decrease in response to the slide switch position between $P_1$ and $P_0$, the magnitude of the current through the LED(s) 200 also decreases. At $P_0$, the magnitude of the current through the LED(s) 200 has decreased to its lowest magnitude. While this magnitude is depicted as being at or near zero in FIG. 3D, those of ordinary skill will recognize that the lowest current magnitude through the LED(s) 200 may be non-zero, depending on the regulated current magnitude of the shunt 310. No additional dimming of the LED(s) 200 is possible after $P_0$.

Figure 4A:
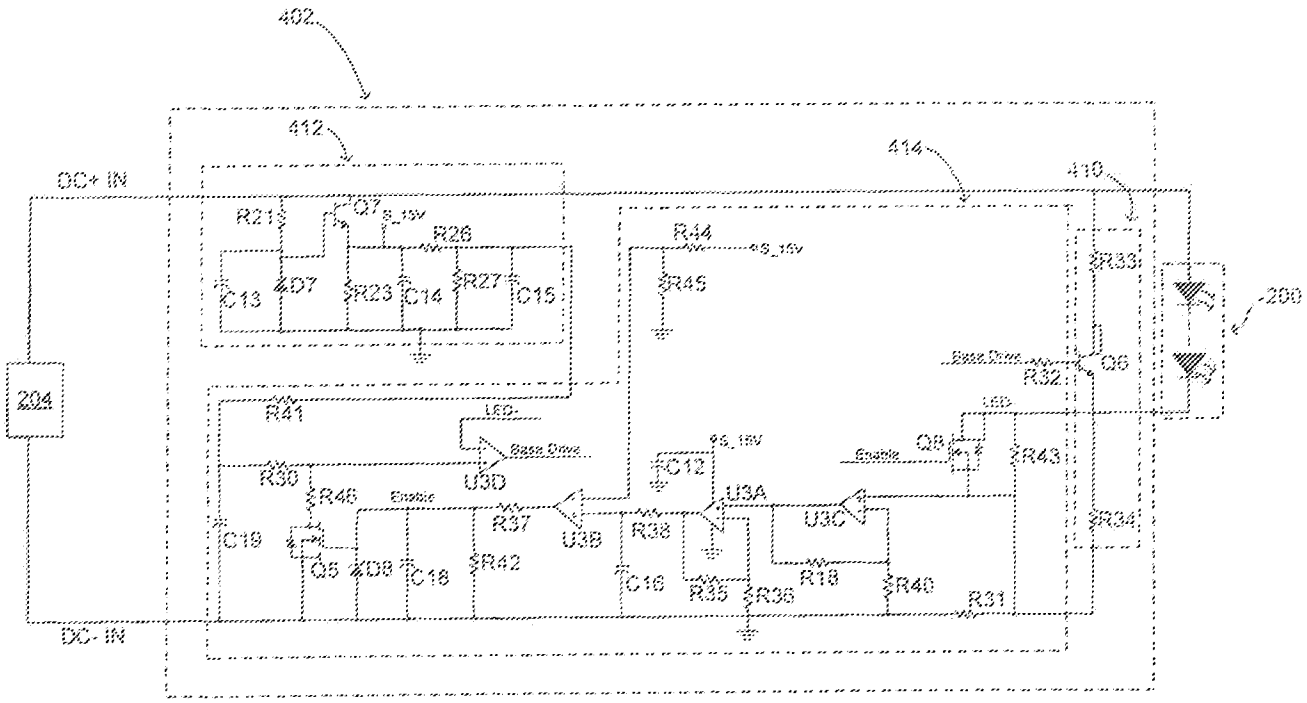
FIG. 4A is a low intensity dimming module circuit schematic according to the second embodiment of the present invention.

Referring next to FIG. 4A, the circuit 402 includes DC positive voltage and ground conductors DC+ IN and DC− IN, respectively, which are, in turn, coupled to the positive and negative output terminals of the driver 204. A shunt 410 is coupled between the conductors DC+ IN and DC− IN.

Like the circuit 302 shown in FIG. 3, the shunt 410 in FIG. 4 includes resistors R33 and R34, as well as the bipolar junction transistor (BJT) Q6, The resistor R33 is connected to the collector of BJT Q6, while the resistor R34 is collected to the emitter of BJT Q6. The base of BJT Q6 is connected to the output of a shunt control circuit 414. In operation, the shunt 410 is active when the output of the shunt control 414 provides sufficient drive current to turn on the BJT Q6. The shunt 410 is otherwise inactive.

The shunt control 414 includes the op amps WA, U3B, and U3C; the capacitors C12, C16, C18, and C19; the resistors R18, R30, R31, R32 R35, R36, R37, R38, R40, R41, R42, R43, R44, and R45; the zener diode D8; and the MOSFETs Q5 and Q8. Unlike the shunt control 314 of FIG. 3, the inverting input of the op amp U3D in the shunt control 414 is connected to a feedback signal taken from a cathode end of the LED(s) 200, rather than the emitter of BIT Q6 in the shunt. The non-inverting input of the op amp U3D is coupled by the resistors R30 and R31 to a voltage regulation circuit 412 that develops a first voltage reference signal and a second voltage reference signal from the DC positive voltage on the conductor DC+ IN. The voltage regulation circuit 412 includes the resistors R21, R23, R26, and R27; the capacitors C13, C14, and C15; the zener diode D7; and the transistor Q7.

The shunt control 414 uses the current magnitude through the LED(s) 200 as a feedback signal that is coupled to the inverting input of the op amp U3D in the shunt control 414. Additionally, the inverting input of the op amp U3B receives the second voltage reference signal developed by a voltage divider comprising the resistors R44 and R45. The shunt control 414 is configured to activate the shunt 410 when the magnitude of the driving current is detected to be below the low intensity threshold current magnitude.

Specifically, the op amp U3C compares a voltage at a junction between the resistors R43 and R31 to a voltage developed at an inverting input thereof to develop an LED current magnitude signal. When a signal on a conductor ENABLE is high the MOSFET Q8 is fully on, thereby shorting the current sense resistor 143. When the signal on conductor ENABLE is low, the MOSFET Q8 is off, and the voltage across the current sense resistor R43 is sampled. The op amps U3C and U3A level shift the LED current magnitude signal. The op amp U3B compares the level shifted signal representing the current magnitude against the second voltage reference signal developed by the voltage regulation circuit 312. The output signal of the op amp MB turns the clamping MOSFET Q5 on and off based on the comparison.

When the commanded current through the LED(s) 200 is reduced to the low intensity threshold current level, the op amp U3A causes the voltage at the non-inverting input of the op amp U3B to become less than the voltage at the inverting input thereof, thereby resulting in turn-off of the transistor Q5 by the op amp U3B. The low level clamping action on the non-inverting input of the op amp U3D is removed, and the op amp U3D operates the transistor Q6 to activate the shunt 410 and maintain the LED current at a regulated level.

As in other embodiments, the shunt 410 is coupled in parallel with the LED(s) 200 and begins to conduct once the low intensity threshold current level is reached (e.g., 70 mA). As discussed above, an operational difference between the shunt dimming circuit 414 of FIG. 4 and the shunt dimming circuit 314 of FIG. 3 is that the shunt control 414 of FIG. 4 is responsive to the current through the LED(s) 200 (via the feedback signal) and regulates the current through the LED(s) 200 to the low intensity threshold current level instead of regulating the current through the shunt 410 to the low intensity threshold current level. This still results in step dimming but allows for there to be a constant current level (for example, 7 mA) through the LED(s) 200, rather than a constant current level through the shunt. The circuit 402 is designed to be independent of several system variables, such as, for example, differences between drivers with respect to minimum load level, differences in impedance between different dimming control modules, and variations in LED forward voltages. Preferably, the LED(s) 200 remain at a constant output intensity once the shunt 410 is activated. In this configuration, one would not see additional dimming, but a true step response with the shunt 410 current varying. This would guarantee a set minimum LED 200 intensity level, while also avoiding adverse effects such as flickering, noise, etc.

Referring next to FIGS. 4B-4D, a graph of current versus slide switch position is shown with respect to the operation of the driver 204, the shunt 410, and the LED(s) 200, respectively, according to the second embodiment. As shown in FIG. 4B, the magnitude of the driver current decreases as the slide switch is moved downwardly (i.e., as position is varied farther to the right as seen in the graph). While the magnitude of the driver current is shown to decrease linearly with change in slide switch position, the rate of decrease may alternatively be exponential, logarithmic, or any other type of curve known to those of ordinary skill. At position $P_1$, the driver current reaches the low intensity threshold current magnitude and the shunt 410 turns on. The driver current is not affected, however, and continues to decrease as the slide switch moves toward $P_0$. At position $P_0$, the driver current approaches the minimum current magnitude. However, as shown, the driver 204 is configured such that the driver current never actually reaches the minimum current magnitude, so as to avoid any adverse effects.

As shown in FIG. 4C, the magnitude of the shunt current is zero when the magnitude of the driver current is greater than the low intensity threshold current magnitude. At position $P_1$, the driver current magnitude equals the low intensity threshold current magnitude and the shunt 410 is activated. Once activated and as the slide switch is move farther downward, the current through the shunt 410 increases from zero to a particular magnitude. While in FIG. 4C the particular magnitude is shown to be greater than or equal to the minimum current magnitude, the magnitude may be any value less than or equal to the low intensity threshold current magnitude. The magnitude of the current through the shunt 410 depends upon the regulated current magnitude of the LED(s) 200. As the magnitude of the driver current continues to decrease in response to change of the slide switch position between $P_1$ and $P_0$, the magnitude of the current through the shunt 410 also decreases. At $P_0$, the magnitude of the current through the shunt 410 is decreased to its lowest magnitude. While this magnitude is depicted as being at or near zero in FIG. 4C, those of ordinary skill will recognize that the lowest current magnitude through the shunt 410 may be non-zero, depending on the current magnitude at which the LED(s) 200 is regulated.

As shown in FIG. 4D, the magnitude of the current through the LED(s) 200 initially decreases along with the driver current when the slide switch is left of $P_1$. As the current through the LED(s) 200 decreases so does the intensity of the light produced by the LED(s) 200. While the magnitude of the current through the LED(s) 200 is shown to decrease linearly with respect to changes in slide switch position, the rate of decrease may alternatively be exponential, logarithmic, or any other type of curve known to those of ordinary skill. At position $P_1$, the driver current reaches the low intensity threshold current magnitude and the shunt 410 is activated.

When the shunt 410 is activated the shunt 410 begins to conduct current and the magnitude of the current through the LED(s) 200 decreases in step fashion. The magnitude of the step decrease is dependent upon the regulated current magnitude of the LED(s) 200. As the magnitude of the driver current continues to decrease in response to the slide switch position between $P_1$ and $P_0$, the magnitude of the current through the LED(s) 200 remains constant. No additional dimming of the LED(s) 200 occurs for slide switch movement below position $P_1$.

Referring next to FIG. 5, a shunt dimming circuit 502 that uses a 0-10V sample control is shown. The shunt dimming circuit 502 includes a sawtooth generator/oscillator 504 that develops a 600 Hz, sawtooth waveform, which has a magnitude that varies between 6 volts and 8 volts. A level shifter and DC bias converter 506 shifts the 600 Hz, sawtooth waveform to a 600 Hz sawtooth waveform having a magnitude that varies between 600 volt and 1 volt. The resulting sawtooth waveform is compared to a signal on a conductor INPUT by a pulse-width modulation (PWM) comparator 508 comprising op amp U4C. The signal on the conductor INPUT is derived from the DIM_IN dimming command signal outputted by the dimming control module 201. Specifically, a differential amplifier 509 converts signals DIM_IN+ and DIM_IN− into an isolated signal representing DIM_IN on the conductor INPUT. The comparison undertaken by the op amp U4C results in the generation of a PWM waveform that is converted to a DC reference voltage by a filter circuit 520 and the DC reference voltage is applied to a current regulator 516. The current regulator 516 includes an op amp U3D and a BJT Q6 coupled in series between a first shunt resistor R33 and a second shunt resistor R34. The first shunt resistor R33 is further coupled to a node 518. The LED(s) 200 are connected between the node 518 and a shunt control 514.

The circuit 502 further includes a voltage regulation circuit 512 that develops a voltage reference signal from the DC positive voltage on the conductor DC+ IN. The voltage regulation circuit includes resistors R21, R23, R26, and R27; capacitors C13, C14, and C15; zener diode D7; and transistor Q7.

During operation of the circuitry of FIG. 5 while the signal on conductor INPUT is above 1 volt the BJT Q6 is maintained in an off condition and a MOSFET Q8 is fully on, thereby shorting a current sense resistor R43. Under this condition all the power supplied by a driver circuit over conductors 90, 92 is transferred to the LED(s) 200 and the shunt 510 is disabled. During operation while the signal on conductor INPUT is between 1 volt and 0.7 volt, the PWM comparator comprising op amp U4C develops a PWM signal having a duty ratio that varies from 100% at 1V to 5% at 0.7V. The PWM signal is filtered by R51 and C27 to create the DC reference voltage Vref that is used as a reference for the current regulator 516. The LED current is maintained at a magnitude equal to Vref/R43 and, therefore, as the reference voltage Vref drops the current through the LED(s) 200 reduces as well. Because the power supplied over the conductors 90, 92 is developed by a constant current source, (i.e., a constant current magnitude is delivered over the conductors as the signal on conductor INPUT varies between 1V and 0.7V), the effect is to transfer current from the LED(s) 200 to the shunt resistors R33/R34. This transfer is linear starting from 1V down to 0.035V (5% of 0.7V) and the reason for using pulse-width modulation is to translate the signal on the conductor INPUT from a range between 1V-0.7V to a range between 1V and 0.035 V.

The filtered reference voltage Vref is also compared to a 1VDC enable signal by an op amp U3A. If the filtered reference voltage Vref is below 1V the MOSFET Q8 is turned off and the voltage across the current sense resistor R43 is sampled. This enables closed-loop control of the LED current when the signal on the conductor INPUT is at or below 1 volt.

In a circuit 602 corresponding to a fourth embodiment, a microprocessor 604 (or other programmable element, such as an application specific integrated circuit (ASIC)) controls a low intensity dimming module, as shown in FIG. 6. The microprocessor control circuit 602 is similar to the 0-10 V sample control circuit 502. The microprocessor 604 (which may be of the 8-bit type) may replace elements 504, 506, 508, and a portion of 520 from circuit 502. The microprocessor 604 is responsive to the signal on the conductor INPUT and develops a PWM waveform that is supplied to the elements R51, C27, and op amp U4D. The remaining circuitry and function is otherwise similar to or identical to the embodiment of FIG. 5. Further, if desired, the microprocessor 604 (or other programmable element) may implement any desired functional relationship between one or more parameter(s) of the dimming command signal (e.g., magnitude) and LED intensity when the shunt is activated. This functional relationship may be implemented through appropriate programming of the programmable device either alone or in combination with one or more additional external elements (not shown). The programmable device can also be programmed to control the point in the dimming command signal at which the shunt is activated and to determine the initial shunt current magnitude (and thus the LED current magnitude) at the moment the shunt is activated.

Figure 7:
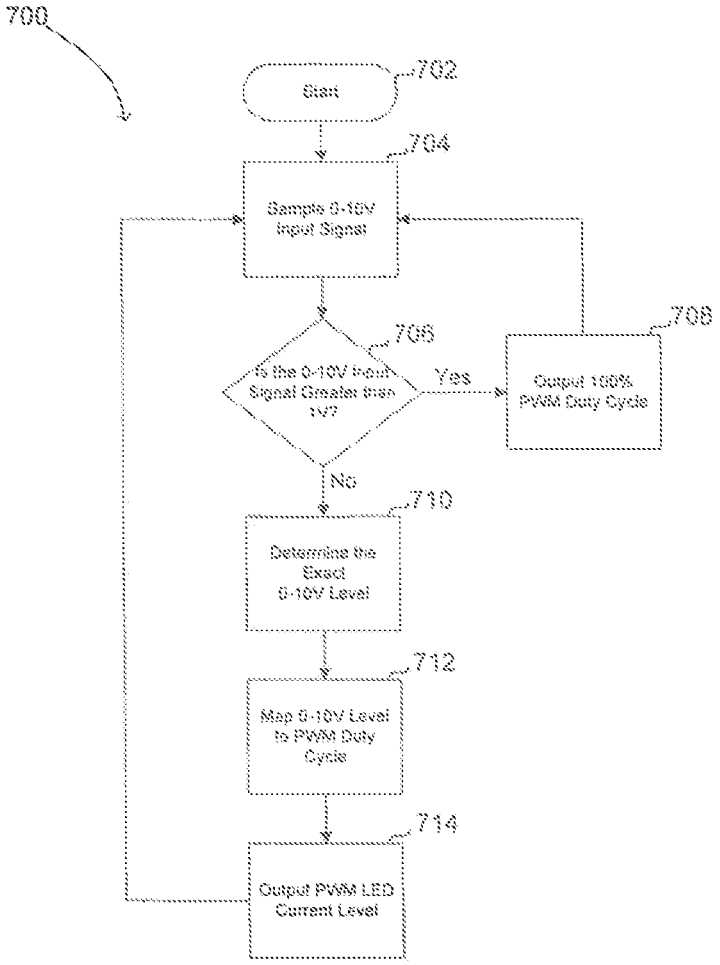
FIG. 7 is a flowchart of programming that may be executed by the microprocessor of FIG. 6.

Referring next to FIG. 7, a flowchart of an example programmed operation 700 of the microprocessor 604 or some other programmable element is shown. The operation of the microprocessor 604 begins at a step 702. At a step 704 the microprocessor 604 samples the voltage magnitude on the conductor INPUT. If the voltage magnitude on the conductor INPUT is greater than 1 V, the program proceeds to a step 708. If the voltage magnitude on the conductor INPUT is less than 1 V, the program proceeds to a step 710.

When the voltage magnitude on the conductor INPUT is less than 1 V, the microprocessor 604 outputs a PWM waveform with a duty cycle of 100% at the step 708 that will activate a shunt 610 through the op amps U3D and U4D. After the step 708, the microprocessor 604 repeats the program beginning at the step 704.

When the magnitude on the conductor INPUT is greater than 1 V, the microprocessor 604 makes a specific determination of voltage magnitude on the conductor INPUT at the step 710. Thereafter, at a step 712, the microprocessor 604 maps the voltage magnitude to an appropriate PWM duty cycle. At a step 714 the microprocessor 604 outputs the PWM waveform with the duty cycle mapped to in the step 714. The microprocessor then repeats the program beginning at the step 704.

Persons of ordinary skill will understand that the sampled voltage magnitude on the conductor INPUT may be outside the range of 0-10 V and that the condition specified in the step 706 may be based on a voltage magnitude other than 1 V, depending on the desired implementation. Further, the PWM duty cycle outputted at the step 708 may be programmatically varied to be other than 100%, depending on the desired implementation. Additionally, the mapping of the sampled voltage magnitude on the conductor INPUT to an appropriate PWM duty cycle at the step 712 may be implemented in numerous ways depending on the desired implementation. The programmed operation 700 illustrated in FIG. 7 is one of several potential implementations of the microprocessor 604.

As should be evident from the foregoing, the embodiments of FIGS. 3A and 4A utilize a static input command signal to the inverting input of the op amp U3D, resulting in a step in the response curves of FIGS. 3B-3D and 4B-4D, whereas the embodiments of FIGS. 5 and 6 employ a variable input command signal to the inverting input of the op amp U3D. The embodiments of FIGS. 5 and 6 have response curves that may be of any desired shape(s) including shape(s) that include or do not include step(s). Also, the command signal used in any of the embodiments could be generated and delivered over wire(s) or wirelessly, such as by Bluetooth, Wi-Fi, LAN, or the like.

To summarize, the present invention comprehends the use of a shunt and any of a. number of various control methodologies to operate a the shunt and/or a load coupled to the shunt such that a driver supplies a current magnitude above a minimum level to avoid operational difficulties. The control methodologies and circuits that implement same may be as described above, or may be varied as would be evident to one of ordinary skill in the art. For example, the linear shunt current diversion schemes described above could be replaced by a PWM or pulse amplitude modulation (PAM) scheme of operating the shunt and/or the load, or a combination of such approaches, or the like.

INDUSTRIAL APPLICABILITY

There is a sizeable customer demographic that values being able to dim an LED lamp to low levels of intensity (i.e., below 5%). Meeting this customer demand has an obvious utility to lighting manufacturers in a competitive market Meeting the demand with a stand-alone, low-cost circuit or module that is not integrated into a pre-existing driver allows the circuit or module to be used with off the shelf drivers, thereby increasing the utility and versatility. The circuit or module could also be used as a field upgrade to lamp fixtures that are already in use.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

I claim:

1. A dimmable lighting device, comprising:

at least one light emitting diode (LED);

an LED driver configured to develop a driving current to power the at least one LED; and a dimming control circuit comprising a shunt load, said dimming control circuit being configured to divert current from said at least one LED through said shunt load in response to the driving current being below a low intensity threshold level;

wherein an LED current magnitude through said at least one LED is equal to the driving current when the driving current is above the threshold level, the LED current magnitude changes according to a step function when the driving current is at the threshold level, and the LED current magnitude comprises a linear characteristic when the driving current is below the threshold level; and wherein the relationship between the LED current magnitude and the driving current is different when the driving current is above the threshold level as compared to the relationship between the LED current magnitude and the driving current when the driving current is below the threshold level.

2. The device of claim 1, wherein the low intensity threshold level of the driving current is determined in accordance with a dimming control signal.

3. The device of claim 1, wherein the dimming control circuit is configured not to divert current from said at least one LED when said driving current is at or above the low intensity threshold level.

4. The device of claim 3, wherein the LED driver is operable above a minimum current magnitude and wherein the low intensity threshold level is greater than the minimum current magnitude.

5. The device of claim 1, wherein the at least one LED is powered by a portion of the driving current that is not diverted through said shunt load.

6. The device of claim 1, further comprising a junction box, wherein the dimming control circuit is disposed within said junction box.

7. The device of claim 1, wherein the shunt load comprises a resistor, and wherein power generated by the diverted current is dissipated as heat by the resistor.

8. The device of claim 7, wherein the shunt load further comprises a transistor coupled to the resistor.

9. The device of claim 1, wherein the dimming control circuit is responsive to an input command signal.

10. The device of claim 9, wherein the input command signal is static.

11. The device of claim 10, wherein the dimming control circuit directly controls a magnitude of current through the at least one LED.

12. The device of claim 10, wherein the shunt load receives a current comprising a magnitude regulated by the dimming control circuit.

13. The device of claim 1, wherein the at least one LED receives a current magnitude represented by a response curve comprising a step.

14. The circuit of claim 1, wherein the dimming control circuit is responsive to a 0-10V dimming control signal.

15. A dimming circuit for a lighting device, comprising:

a first current path configured to be connected to a light emitting diode (LED) driver, wherein the LED driver is configured to develop a driving current to power at least one LED;

a second current path connected to the first current path, wherein the second current path comprises a shunt load that is switchable between an off condition and an on condition;

a shunt control circuit coupled to the shunt load that switches the shunt load between the off condition and the on condition, wherein the shunt control circuit maintains the off condition of the shunt load when a commanded driving current is above a threshold level, and wherein the shunt control circuit switches the shunt on and controls current flow through one of the first current path and the second current path when a commanded driving current is less than the threshold level; and a dimming control circuit that develops a dimming command signal to control the LED driver;

wherein the shunt control circuit receives a feedback control signal from one of the shunt load and the at least one LED;

wherein the dimming control circuit and the shunt control circuit operate to control the current flow through the first current path and the second current path; and wherein the relationship between the current flow and the driving current is different when the driving current is above the threshold level as compared to the relationship between the current flow and the driving current when the driving current is below the threshold level; and wherein the current flow changes according to a step function when the driving current is at the threshold level.

16. The circuit of claim 15, wherein the shunt load comprises a resistor and a junction transistor, and wherein current flowing through the shunt load is dissipated as heat by the resistor.

17. The circuit of claim 16, wherein the LED driver is operable above a minimum current magnitude and wherein the threshold level is greater than the minimum current magnitude.

18. The circuit of claim 16, wherein the at least one LED is powered by a current comprising a magnitude regulated by the dimming control circuit.

19. The circuit of claim 16, wherein the shunt load receives a current comprising a magnitude regulated by the dimming control circuit.

20. The circuit of claim 15, wherein the dimming control circuit is responsive to an input command signal.

21. The circuit of claim 20, wherein the input command signal is static.

22. The circuit of claim 21, wherein the shunt load receives a current comprising a magnitude regulated by the dimming control circuit and the shunt control circuit.

23. The circuit of claim 21, wherein the dimming control circuit directly controls a magnitude of current through the at least one LED.

24. The circuit of claim 20, wherein the input command signal is variable.

25. The circuit of claim 15, wherein the at least one LED receives a current magnitude represented by a response curve comprising a step.

26. The circuit of claim 15, wherein the dimming circuit is responsive to a 0-10V dimming control signal.

27. A dimmable lighting device, comprising:

at least one light emitting diode (LED);

an LED driver configured to develop a driving current to power the at least one LED; and a dimming control circuit comprising a shunt load, said dimming control circuit being configured to divert current from said at least one LED through said shunt load in response to the driving current being below a low intensity level; and a shunt control circuit that receives a feedback control signal from one of the shunt load and the at least one LED;

wherein the shunt load comprises a resistor, and wherein power generated by the diverted current is dissipated as heat by the resistor;

wherein the dimming control circuit does not divert current through said shunt load when the driving current is above the low intensity level;

wherein the dimming control circuit develops a dimming command signal; and wherein the shunt control circuit operates the shunt in response to the feedback control signal and the dimming command signal; and wherein the relationship between the diverted current and the driving current is different when the driving current is below the low intensity level as compared to the relationship between the diverted current and the driving current when the driving current is above the low intensity level.

28. The device of claim 27, wherein the shunt control circuit is configured to divert current in a linear fashion.

29. The device of claim 27, wherein the dimmable lighting device is responsive to a 0-10V dimming control signal.

* * * * *